US010053311B2

(12) United States Patent
Bui

(10) Patent No.: US 10,053,311 B2
(45) Date of Patent: Aug. 21, 2018

(54) SHEET FEEDING DEVICE AND IMAGE FORMING APPARATUS

(71) Applicant: KYOCERA Document Solutions Inc., Osaka (JP)

(72) Inventor: Long Dang Bui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/686,316

(22) Filed: Aug. 25, 2017

(65) Prior Publication Data

US 2018/0057291 A1 Mar. 1, 2018

(30) Foreign Application Priority Data

Aug. 29, 2016 (JP) ..... 2016-166771

(51) Int. Cl.
*B65H 1/04* (2006.01)
*G03G 15/00* (2006.01)

(52) U.S. Cl.
CPC ..... *B65H 1/04* (2013.01); *G03G 15/6514* (2013.01); *B65H 2402/21* (2013.01); *B65H 2402/64* (2013.01); *B65H 2407/21* (2013.01); *G03G 2215/00392* (2013.01)

(58) Field of Classification Search
CPC ..... B65H 2402/441; B65H 2402/45; B65H 2402/64; B65H 2405/121; B65H 2407/21; G03G 15/6514; G03G 2215/00392; G03G 2215/00713; Y10T 292/0926; Y10T 292/0928; Y10T 292/0929; Y10T 292/0931; Y10T 292/094
USPC ..... 271/9.09
See application file for complete search history.

(56) References Cited

U.S. PATENT DOCUMENTS 7,398,968 B2 * 7/2008 Learmonth ..... G03G 21/1609 271/145
7,676,176 B2 * 3/2010 Fujiwara ..... G03G 21/1633 399/121
9,092,002 B2 * 7/2015 Shimoi ..... G03G 21/1633
9,199,811 B2 * 12/2015 Maruyama ..... B65H 1/04

FOREIGN PATENT DOCUMENTS

JP 2003-326801 A 11/2003

* cited by examiner

*Primary Examiner* — Jeremy R Severson
(74) *Attorney, Agent, or Firm* — Studebaker & Brackett PC

(57) ABSTRACT

A sheet feeding device includes a side face of a device body and a bypass tray. The bypass tray is supported turnably around a fulcrum part in the side face between a close position along the side face and an open position held at a predetermined angle with the side face. The bypass tray includes a locked piece having a locked hole. The side face includes a locking hook engaging with the locked piece when the bypass tray is at the close position. The locking hook includes an elastically deformable arm part, an engaging protrusion part protruded inwardly from a distal end of the arm part in a width direction of a sheet to insert into the locked hole, and a regulating part coming into contact with an opening edge of the locked hole to regulate an insertion amount of the engaging protrusion part to the locked hole.

10 Claims, 13 Drawing Sheets

SHEET FEEDING DEVICE AND IMAGE FORMING APPARATUS

INCORPORATION BY REFERENCE

This application is based on and claims the benefit of priority from Japanese Patent application No. 2016-166771 filed on Aug. 29, 2016, the entire contents of which are incorporated herein by reference.

BACKGROUND

The present disclosure relates to a sheet feeding device including a manual bypass tray and an image forming apparatus including this sheet feeding device.

An image forming apparatus, such as a printer or a multifunction peripheral, includes a sheet feeding device including a manual bypass tray. The sheet feeding device is configured so as to feed a sheet stacked on the manual bypass tray for image forming process.

For example, in the image forming apparatus, an inversion unit may be configured to include the manual bypass tray and to be detachably attached to an apparatus body. The manual bypass tray includes a sensor sensing whether or not the sheet is stacked, and then, on the basis of this sensed result, an inversion function of the inversion unit is controlled. The manual bypass tray is concurrently used as a cover for jam treatment to be openable and closable.

The sheet feeding device including the manual bypass tray is configured so that the manual bypass tray is arranged turnable with respect to a storage recessed part provided in a front cover or the like of an apparatus body. A turning axis direction of the manual bypass tray is a width direction of the sheet (a sheet width direction) on the manual bypass tray. The manual bypass tray has positioning bosses as turning axes at both ends in the sheet width direction and the positioning bosses determine a feeding position of the sheet from the manual bypass tray. The storage recessed part has positioning holes at both ends in the sheet width direction and the positioning bosses are attached to the positioning holes. If the manual bypass tray is not used, the manual bypass tray is turned and stored in the storage recessed part.

The storage recessed part includes locking parts, such as snap-fits, at left and right internal lateral faces and the manual bypass tray includes locked holes locked by the snap-fits at left and right lateral faces. By locking the snap-fits with respect to the locked holes, the manual bypass tray is fixed in a state stored in the storage recessed part. Although the locking part, such as the snap-fit, is locked to the locked hole by utilizing elastic deformation, if the locking part receives load, such as deep insertion into the locked hole, while temperature variation of installation environment of the printer is repeated, the locking part may be immoderately deformed. The snap-fit may be left deforming without being restored to its original shape, depending on the circumstances, opening and closing of the manual bypass tray may become impossible.

Thereupon, in order to assist locking and restoring of the shape using elastic force of the snap-fit and to make locking performance of the snap-fit excellent, a plate spring may be provided. However, the plate spring may be easily come off the snap-fit. If the snap-fit is provided with a hole or the like in order to fix the plate spring, strength of the snap-fit may be degraded, and then, locking performance of the snap-fit may be degraded.

SUMMARY

In accordance with an embodiment of the present disclosure, a sheet feeding device includes a side face of a device body and a bypass tray. The bypass tray is supported so as to be turned around a fulcrum part with respect to the side face between a close position along the side face and an open position held at a predetermined angle with respect to the side face. The bypass tray includes a locked piece arranged above the fulcrum part and having a locked hole. The side face includes a locking hook engaging with the locked piece when the bypass tray is at the close position. The locking hook includes an arm part being capable of elastically deforming, an engaging protrusion part and a regulating part. The engaging protrusion part is protruded from a side of a distal end of the arm part to an inward side in a width direction orthogonal to a conveyance direction of a sheet to insert into the locked hole. The regulating part comes into contact with an opening edge of the locked hole to regulate an insertion amount of the engaging protrusion part to the locked hole.

In accordance with an embodiment of the present disclosure, an image forming apparatus includes the above-described sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, the entire structure of a printer 1 (an image forming apparatus) according to an embodiment of the present disclosure will be described with reference to drawings. In the embodiment, forward and backward directions of the printer 1 are a conveyance direction of a sheet (a sheet conveyance direction), and left and right directions of the printer 1 are a width direction of the sheet (a sheet width direction) orthogonal to the conveyance direction.

Figure 1:
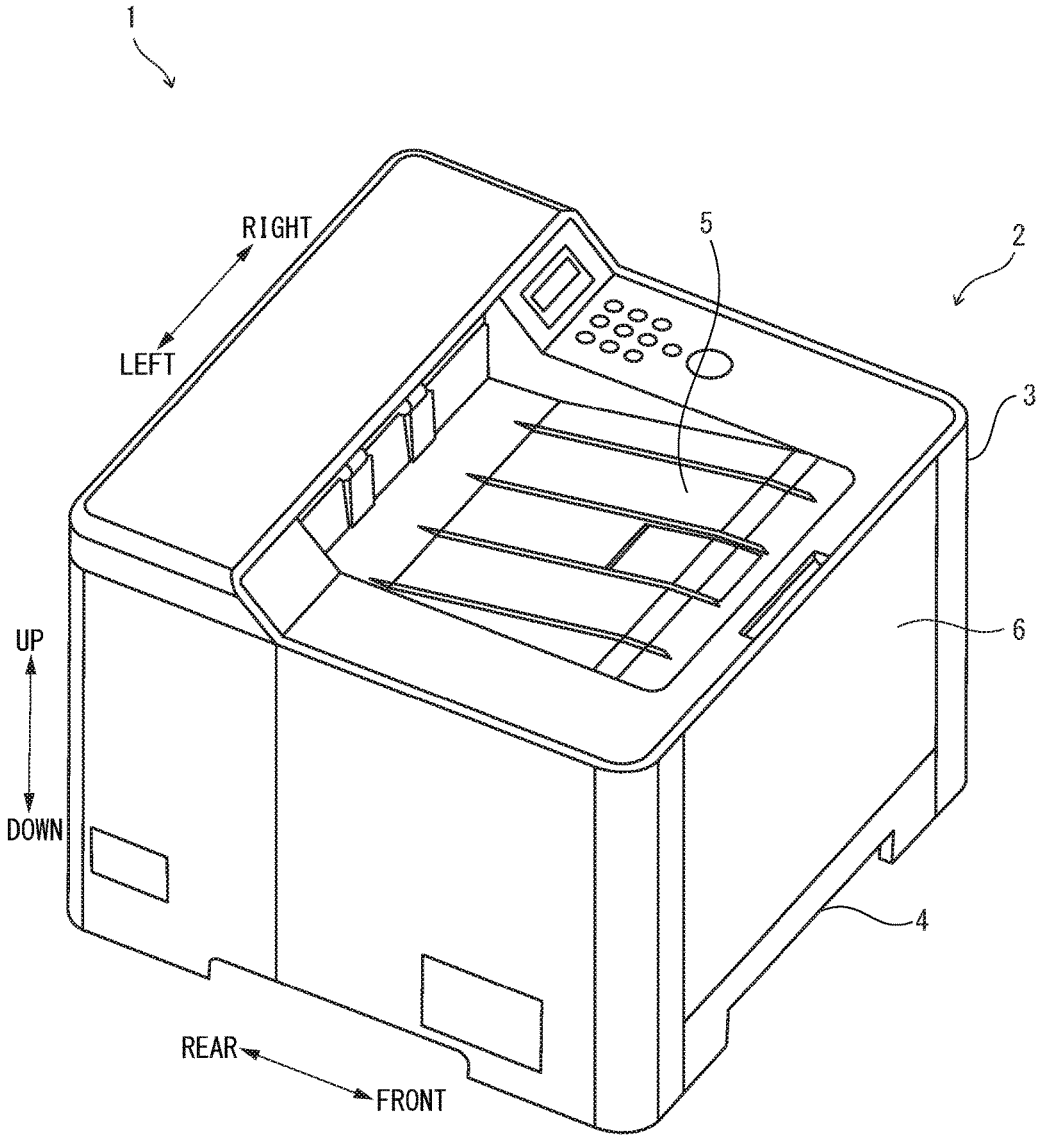
FIG. 1 is a perspective view showing a printer according to an embodiment of the present disclosure.

As shown in FIG. 1 and other figures, the printer 1 includes a box-like formed printer body 2 (an apparatus body). A front part of the printer body 2 is composed of a front cover 3 erected. The front cover 3 has a storage recessed part 3*a* recessed to a back side at the center in the left and right directions. In a lower part inside the printer body 2, a sheet feeding cartridge 4 storing the sheet is installed. In an upper end of the printer body 2, an ejected sheet tray 5 is formed. The sheet feeding cartridge 4 is configured so as to be detached and attached in the forward and backward directions via an opening below the storage recessed part 3*a* of the front cover 3.

Figure 2:
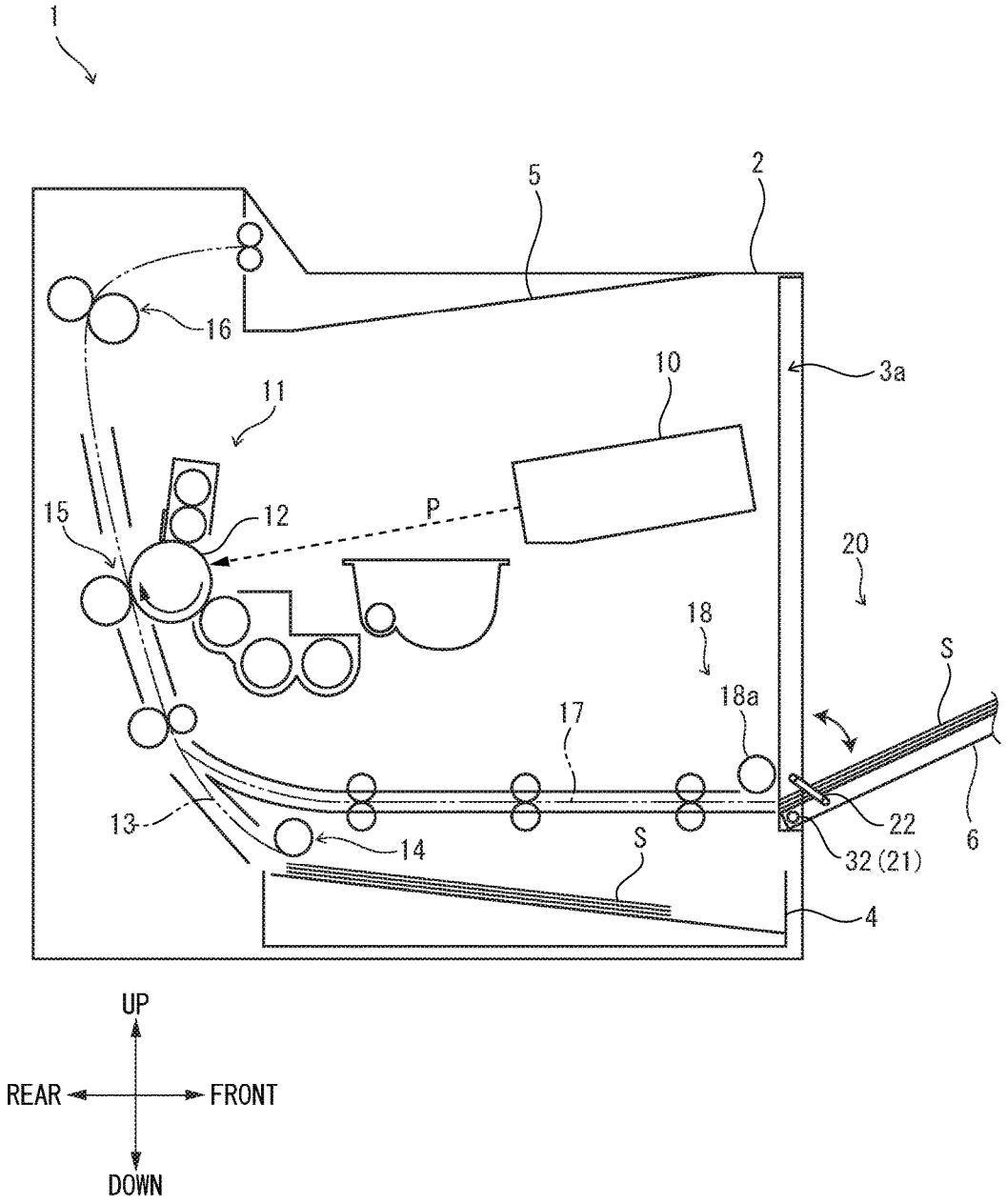
FIG. 2 is a sectional view schematically showing the printer according to the embodiment of the present disclosure.

The storage recessed part 3*a* of the front cover 3 is formed so as to be capable of storing a manual bypass tray 6 (a bypass tray). With respect to the storage recessed part 3*a*, the manual bypass tray 6 is supported so as to be turned between a close position (refer to FIG. 1) along the front cover 3 and an open position (refer to FIG. 3) held at a predetermined angle with respect to the front cover 3 and capable of stacking the sheet to be fed. For example, as shown in FIG. 2, a close direction closing the manual bypass tray 6 to the close position is a counterclockwise direction as viewed from a left side and an open direction opening the manual bypass tray 6 to the open position is a clockwise direction as viewed from the left side. The close position of the manual bypass tray 6 is a position where the manual bypass tray 6 in an erected state is stored in the storage recessed part 3*a* and the open position of the manual bypass tray 6 is a position where the manual bypass tray 6 in a laid state exposes the storage recessed part 3*a*. An outside face side of the manual bypass tray 6 at the close position composes a front face of the printer body 2 together with the front cover 3 and a front face of the sheet feeding cartridge 4. The front cover 3 and the manual bypass tray 6 will be described later in detail.

As shown in FIG. 2, inside the printer body 2, an exposure device 10 composed of a laser scanning unit (LSU) is located at a front part and an image forming part 11 is arranged at a rear part. In the image forming part 11, a photosensitive drum 12 (an image carrier) is rotatably arranged. Around the photosensitive drum 12, a charging device, a development device connected to a toner container, a transfer roller and a cleaning device are located along a rotating direction of the photosensitive drum 12.

In addition, inside the printer body 2, a first conveying path 13 for the sheet is arranged so as to convey the sheet from the sheet feeding cartridge 4 at a lower side to the ejected sheet tray 5 at an upper side via the image forming part 11. At an upstream end of the first conveying path 13, a cartridge sheet feeding part 14 is positioned. At an intermediate stream portion of the first conveying path 13, a transferring part 15 composed of the photosensitive drum 12 and the transfer roller of the image forming part 11 is positioned. At a downstream portion of the first conveying path 13, a fixing device 16 is positioned.

Further, inside the printer body 2, a second conveying path 17 for the sheet is arranged so as to convey the sheet from the manual bypass tray 6 at a front side to a rear side via an upper side of the sheet feeding cartridge 4. At an upstream end of the second conveying path 17, a manual bypass sheet feeding part 18 is positioned. At an intermediate stream portion of the second conveying path 17, a conveyance frame 19 is positioned at a rear side of the manual bypass sheet feeding part 18 (refer to FIG. 12). A downstream end of the second conveying path 17 joins the first conveying path 13 at a downstream side from the cartridge sheet feeding part 14 and at an upstream side from the image forming part 11.

In the embodiment, a sheet feeding device 20 feeding the sheet from the manual bypass tray 6 is composed of the manual bypass sheet feeding part 18, the conveyance frame 19, the storage recessed part 3*a* of the front cover 3 and the manual bypass tray 6. The manual bypass sheet feeding part 18 includes, for example, a sheet feeding roller 18*a* feeding the sheet from the manual bypass tray 6 to the second conveying path 17. The storage recessed part 3*a* composes a side face of a device body of the sheet feeding device 20 at a façade face side (a front face side) of the sheet feeding device 20 and is defined by left and right internal lateral faces 3*b* of the front cover 3. In other words, the storage recessed part 3*a* composing the side face of the device body includes the internal lateral faces 3*b*.

When the manual bypass tray 6 is turned to the open position (refer to FIG. 3) or the manual bypass tray 6 is detached from the printer body 2 (refer to FIG. 4), each component (the exposure device 10, the image forming part 11, the first conveying path 13, the cartridge sheet feeding part 14, the transferring part 15, the fixing device 16, the second conveying path 17, the manual bypass sheet feeding part 18, the conveyance frame 19 and others) inside the printer body 2 becomes a state capable of maintenance, such as jam treatment. For example, a front side of the manual bypass sheet feeding part 18 is exposed in a case where the manual bypass tray 6 is at the open position, but is covered by the manual bypass tray 6 in a case where the manual bypass tray 6 is at the close position.

Next, image forming operation of the printer 1 including such a configuration will be described. In the printer 1, when image data is inputted and a printing start is directed from an external computer or the like connected with the printer 1, image forming operation is started. First, the surface of the photosensitive drum 12 is electrically charged by the charging device of the image forming part 11. Then, photographic exposure corresponding to the image data is carried out to the photosensitive drum 12 by a laser light (refer to a broken line P in FIG. 2) from the exposure device 10, and thereby, an electrostatic latent image is formed on the surface of the photosensitive drum 12. Next, the electrostatic latent image is developed to a toner image by the development device of the image forming part 11 using with the toner.

On the other hand, the sheet stored in the sheet feeding cartridge 4 is picked up by the cartridge sheet feeding part 14 and conveyed on the first conveying path 13. Alternatively, the sheet stacked on the manual bypass tray 6 is picked up by the manual bypass sheet feeding part 18 and conveyed on the second conveying path 17 and the first conveying path 13. By any of these ways, the sheet is conveyed to the transferring part 15 in a given timing. In the transferring part 15, the toner image on the photosensitive drum 12 is transferred onto the sheet. The sheet with the transferred toner image is conveyed to the fixing device 16. In the fixing device 16, the toner image is fixed on the sheet. The sheet with the fixed toner image is ejected to the ejected sheet tray 5.

Figure 4:
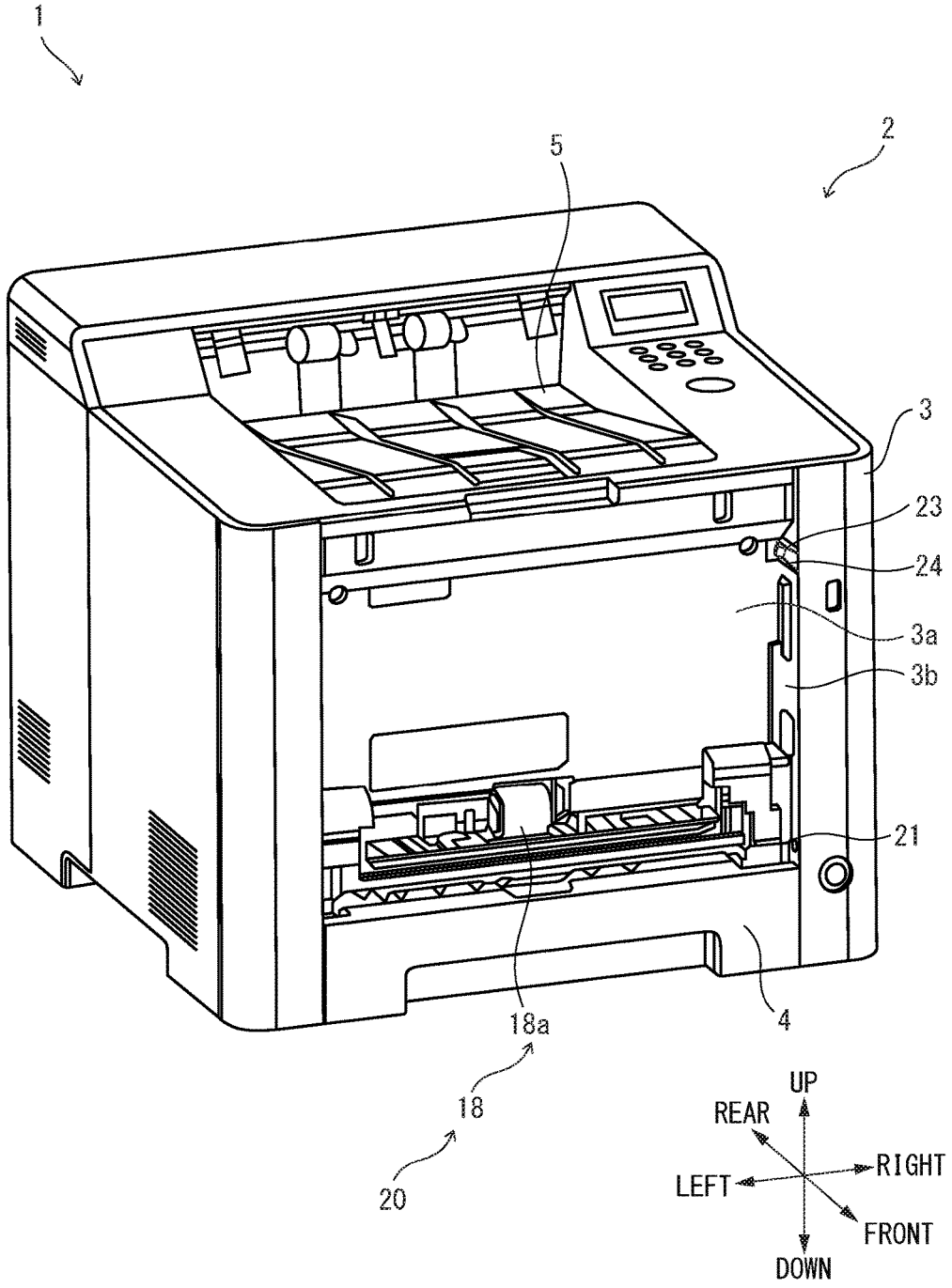
FIG. 4 is a perspective view showing the printer, as viewed from an upper side, in a state that the manual bypass tray is detached, according to the embodiment of the present disclosure.
Figure 5:
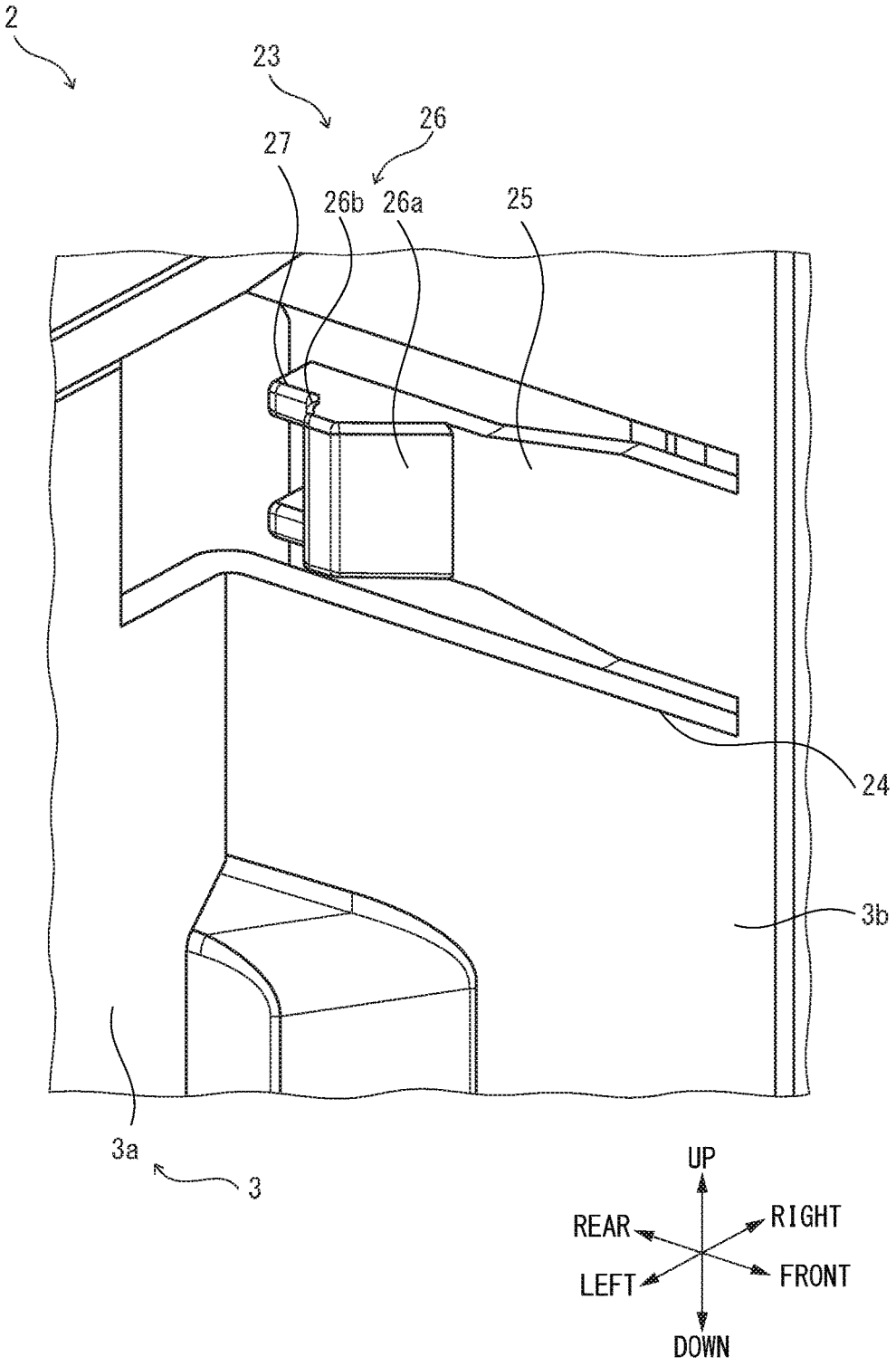
FIG. 5 is a perspective view showing a locking hook of a front cover in the printer according to the embodiment of the present disclosure.

Next, the front cover 3 will be described. The front cover 3 has the left and right internal lateral faces 3*b* composing the storage recessed part 3*a*. In lower portions of the left and right internal lateral faces 3*b*, left and right bearings 21 (a fulcrum part) having an axis direction of the left and right directions are provided. Incidentally, the right internal lateral face 3*b* and the right bearing 21 are shown in FIGS. 4 and 5 and other figures, and the left internal lateral face 3*b* and the left bearing 21 are not shown. The left and right bearings 21 support the manual bypass tray 6 in a turnable state and work as positioning holes positioning the manual bypass tray 6 in upward and downward directions and the forward and backward directions. The left and right bearings 21 are arranged, for example, near the front side of the manual bypass sheet feeding part 18. According to positions of the left and right bearings 21, a feeding position of the sheet from the manual bypass tray 6 to the manual bypass sheet feeding part 18 is determined.

In addition, the front cover 3 includes left and right arms 22 supporting the manual bypass tray 6 at the open position in the left and right internal lateral faces 3*b*. The left and right arms 22 are link members linking the front cover 3 and the manual bypass tray 6 and define the angle of the manual bypass tray 6 at the open position. Incidentally, the left arm 22 is shown in FIG. 2 and the right arm 22 is not shown. The left and right arms 22 are arranged at a position not interfering the manual bypass tray 6 at the close position and are rotated simultaneously with turning of the manual bypass tray 6.

Further, in upper parts of the left and right internal lateral faces 3*b* of the storage recessed part 3*a*, left and right locking hooks 23 are provided. Incidentally, the right locking hook 23 is shown in FIGS. 3-6 and 8-11 and the left locking hook 23 is not shown. The left and right locking hooks 23 are formed symmetrically in the left and right direction to have similar shapes. Hereinafter, the right locking hook 23 will be described except a case of specifying left and right. The locking hook 23 is composed of a snap-fit or the like extended to a rear side from a front edge of a rectangular notch 24 provided in the upper part of the internal lateral face 3*b*. The left and right locking hooks 23 are respectively locked by locked holes 31 of left and right locked pieces 30 of the manual bypass tray 6 described later. Hereinafter, it will be described so that a front end of the locking hook 23 (an end at a side of the front edge of the notch 24) is a proximal end of the locking hook 23 and a rear end of the locking hook 23 is a distal end of the locking hook 23. The left and right locking hooks 23 are arranged so as to face to each other across the storage recessed part 3*a*. Hereinafter, it will be described so that a face of the locking hook 23 at a side of the storage recessed part 3*a* is an outside face of the locking hook 23 and another face of the locking hook 23 at an opposite side to the storage recessed part 3*a* is an inside face of the locking hook 23.

Figure 6:
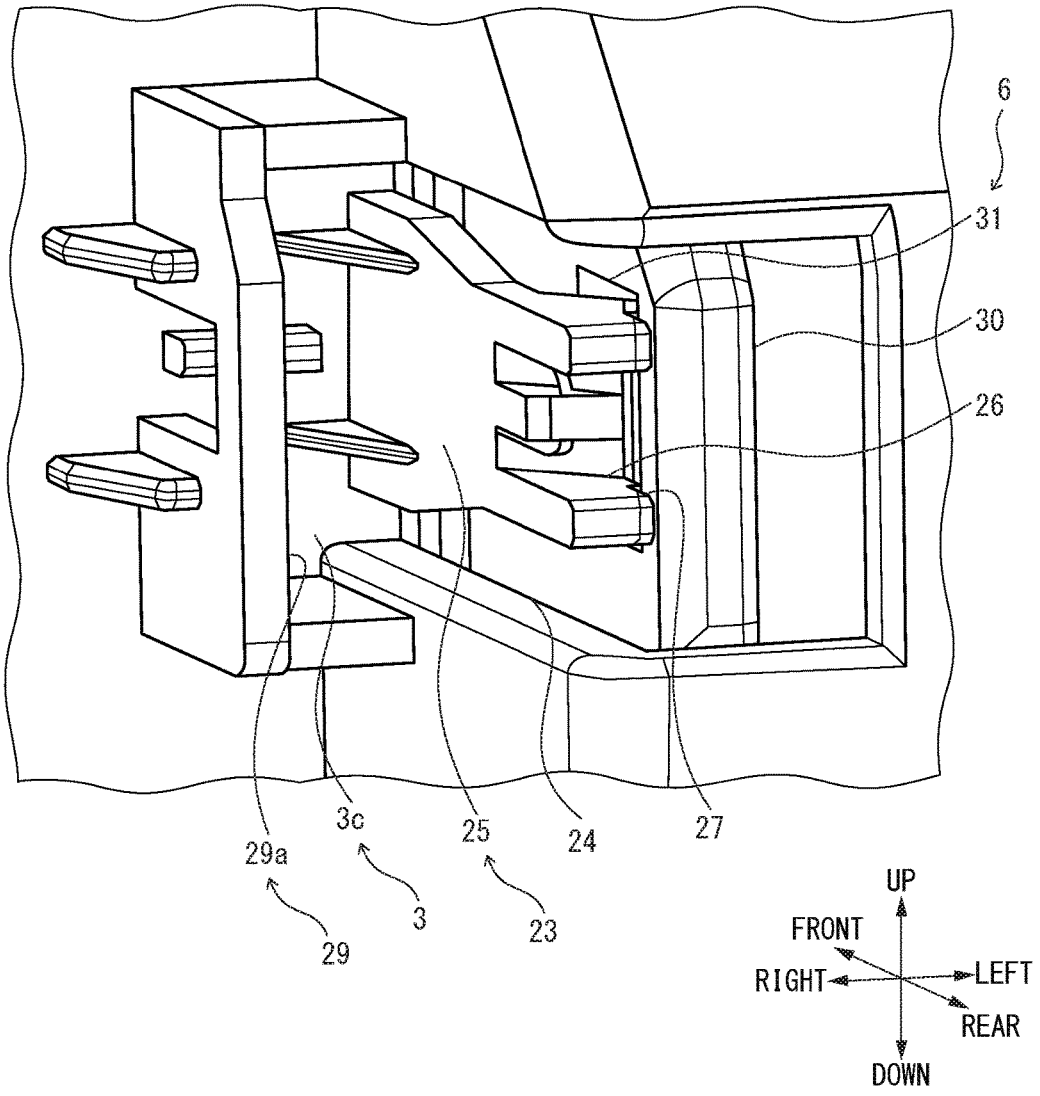
FIG. 6 is a perspective view showing the locking hook and a locked piece in a locking state in the printer according to the embodiment of the present disclosure.
Figure 7:
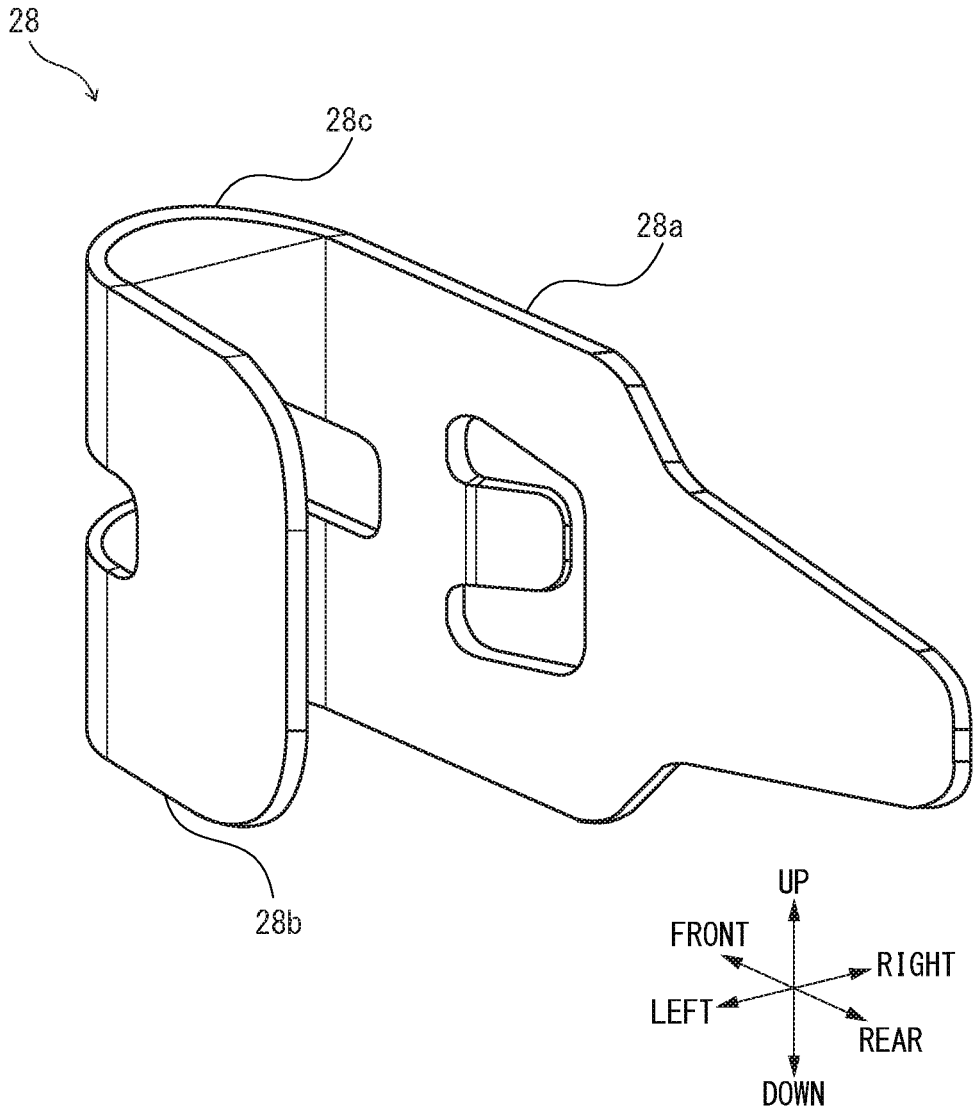
FIG. 7 is a perspective view showing a plate spring installed to a front cover in the printer according to the embodiment of the present disclosure.
Figure 8:
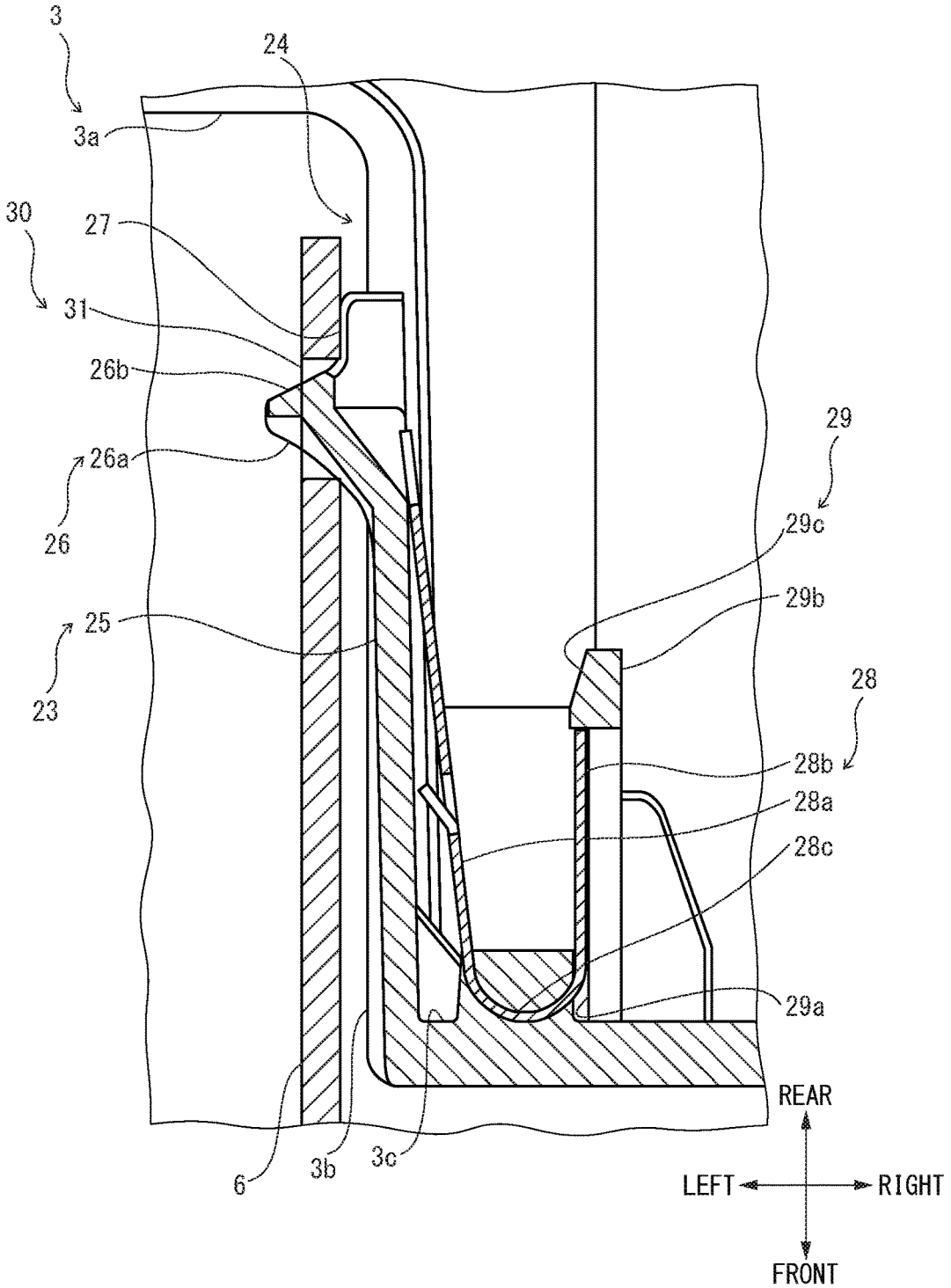
FIG. 8 is a sectional view showing the locking hook and the locked piece in the locking state and the plate spring in an installed state in the printer according to the embodiment of the present disclosure.

Each locking hook 23 include, as shown in FIG. 5 and other figures, an arm part 25 continuing from the front edge of the notch 24, an engaging protrusion part 26 protruded from the arm part 25 to a side of the outside face (to an inward side in the width direction), a regulating part 27 provided at a side of the distal end (a rear side of the engaging protrusion part 26), and a plate spring 28 provided at a side of the inside face of the arm part 25 (refer to FIGS. 7 and 8 and other figures). The arm part 25, the engaging protrusion part 26 and the regulating part 27 of each locking hook 23 are produced integrally with the front cover 3, and the plate spring 28 is detachably attached to the front cover 3. Incidentally, in FIG. 6, the plate spring 28 is not shown.

The arm part 25 is formed in a plate-like member having a longitudinal direction of the forward and backward directions and a lateral direction of the upward and downward directions. A front end of the arm part 25 is continued from the front edge of the notch 24 to become a proximal end of the arm part 25 and a rear end of the arm part 25 becomes a distal end of the arm part 25. The arm part 25 is capable of elastically deforming against pressing to the outside and has restoring force. For example, the arm part 25 produces restoring force to the left side (or the right side) against pressing to the right side (or the left side).

The engaging protrusion part 26 is protruded from the distal end to the side of the outside face in the arm part 25, that is, protruded to the lateral face of the manual bypass tray 6 stored in the storage recessed part 3*a*. Moreover, the engaging protrusion part 26 is formed with a cross section of triangle having an apex arranged at the side of the outside face. The engaging protrusion part 26 has a first inclined face 26*a* at a side of the proximal end (a front side) and a second inclined face 26*b* at a distal end (a rear side). The engaging protrusion part 26 is fitted (inserted) into the locked hole 31 of the manual bypass tray 6 at the close position.

The regulating part 27 is arranged at the side of the distal end from the engaging protrusion part 26 in the arm part 25 and is composed of a pair of regulating ribs 27*a* protruded to the side of the outside face from the arm part 25. The regulating part 27 is formed so that a height of each regulating rib 27*a* in a direction to the side of the outside face is lower than a protruded height of the engaging protrusion part 26. The pair of regulating ribs 27*a* come into contact with a distal end edge (an opening edge) of the locked hole 31 when the engaging protrusion part 26 is fitted (inserted) into the locked hole 31 to regulate an insertion amount of the engaging protrusion part 26 to the locked hole 31.

The plate spring 28 is formed, as shown in FIGS. 7 and 8, in roughly U-shape having a pressing piece 28*a* and a fixed piece 28*b* as a pair of extended portions and having a curved portion 28*c* connecting the pressing piece 28*a* and the fixed piece 28*b*. The pressing piece 28*a* and the fixed piece 28*b* are arranged to continue from both ends of the curved portion 28*c* formed by curving in an arc shape. The plate spring 28 is provided as an assisting member assisting elastic force (restoring force) of the arm part 25 at a side of the inside face of the arm part 25.

Figure 9:
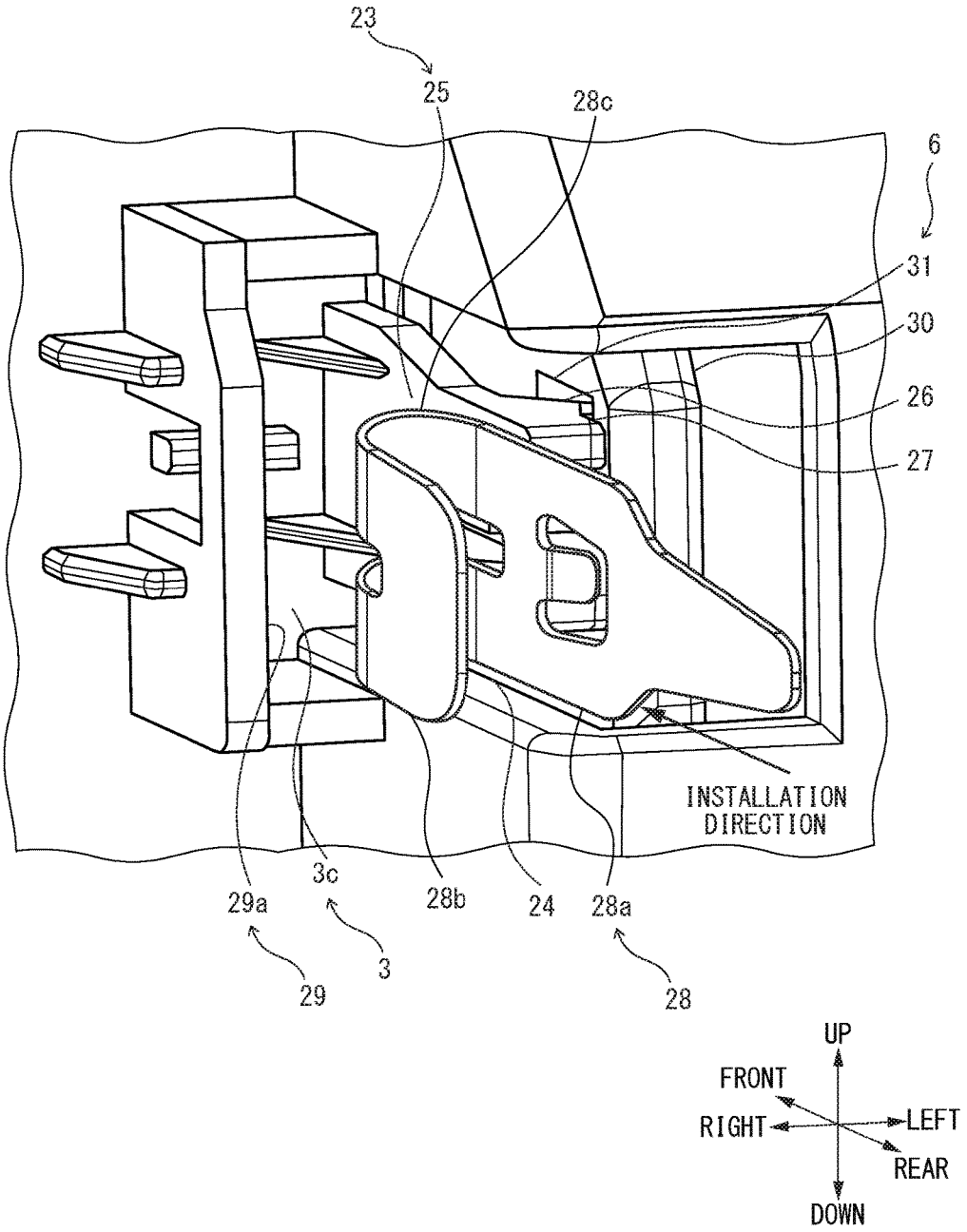
FIG. 9 is a perspective view showing the plate spring before being installed to the front cover, as viewed from a right rear side, in the printer according to the embodiment of the present disclosure.

As shown in FIG. 9, an installation direction of the plate spring 28 is set a direction from the distal end to the proximal end in the arm part 25, and the plate spring 28 is installed while directing the curved portion 28*c* toward the installation direction. When the plate spring 28 is installed to the front cover 3, the curved portion 28*c* comes into contact with, for example, a front side internal face 3*c* of the front cover 3. Moreover, the plate spring 28 is attached so that the pressing piece 28*a* is arranged along the side of the back face of the arm part 25 to press the arm part 25. Incidentally, the front cover 3 includes a holding part 29 holding an end of the fixed piece 28*b* of the plate spring 28 at a position separated from the arm part 25 to the side of the back face (an outward side in the width direction).

Figure 10:
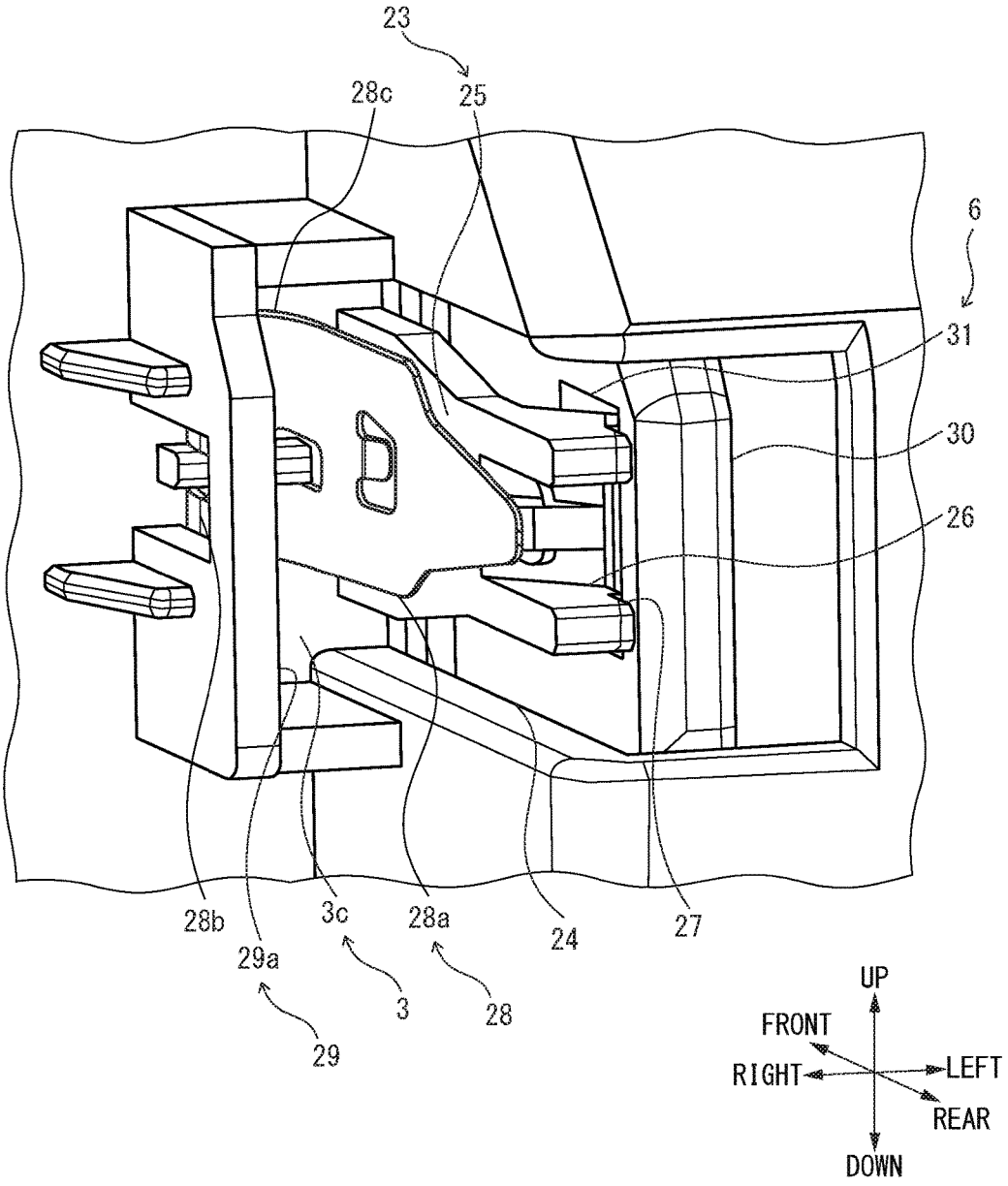
FIG. 10 is a perspective view showing the plate spring having installed to the front cover, as viewed from the right rear side, in the printer according to the embodiment of the present disclosure.
Figure 11:
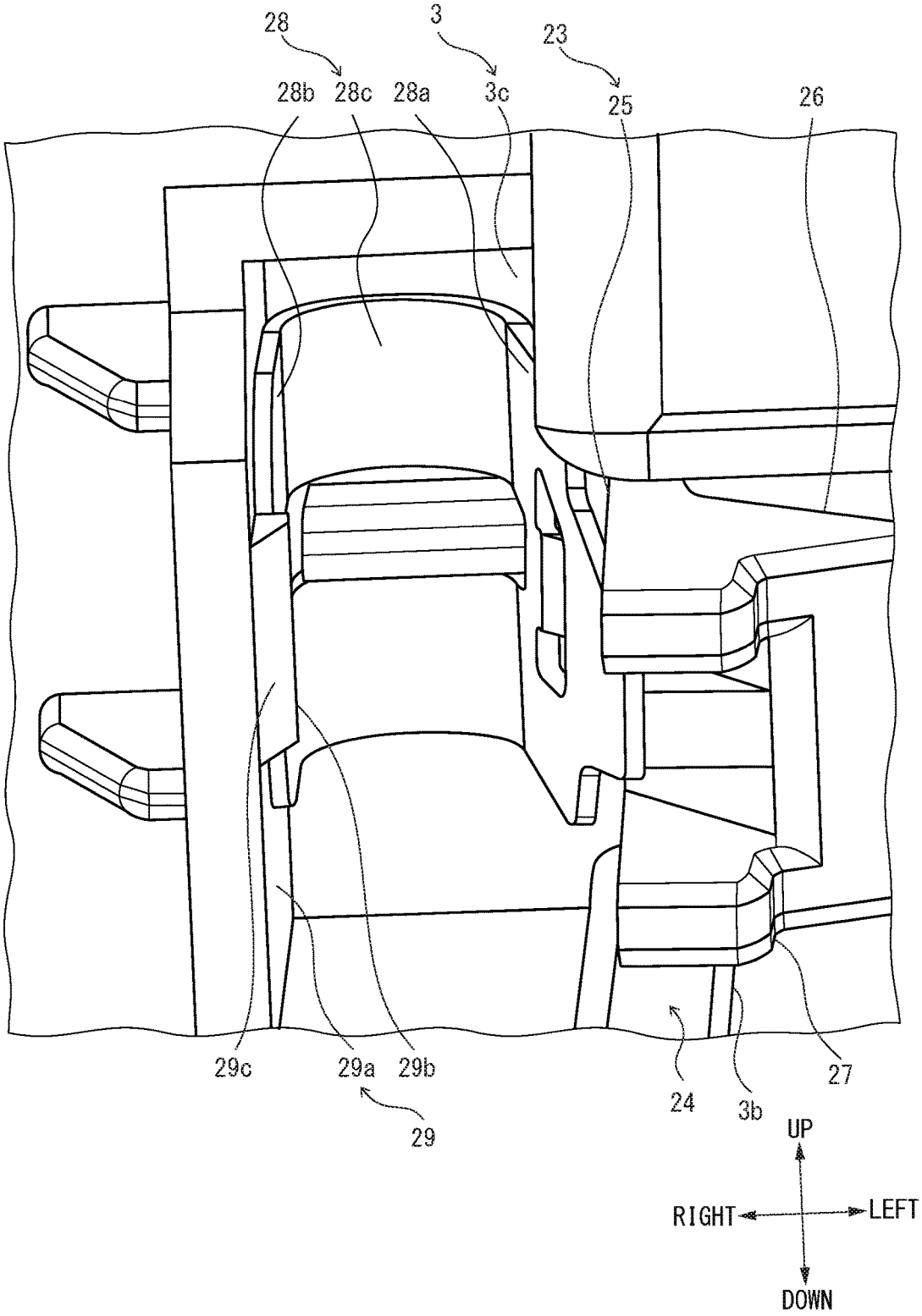
FIG. 11 is a perspective view showing the plate spring having installed to the front cover, as viewed from a rear side, in the printer according to the embodiment of the present disclosure.

The holding part 29 has a holding side face 29*a* arranged so as to face to the back face of the arm part 25 at a position separated from the back face of the arm part 25 in the left and right directions. The holding side face 29*a* and the front side internal face 3*c* of the front cover 3 define a housing space housing the curved portion 28*c* of the plate spring 28. Moreover, the holding part 29 has a fixing protrusion portion 29*b* (a fixing protrusion) at a rear end of the holding side face 29*a*. The fixing protrusion portion 29*b* is protruded to a side of the arm part 25 from the holding side face 29*a*. The fixing protrusion portion 29*b* has a guiding face 29*c* arranged at a near side in the installation direction and inclined from the side of the arm part 25 to the holding side face 29*a* and toward a downstream side in the installation direction. As shown in FIG. 9, when the plate spring 28 is installed, the fixed piece 28*b* of the spring plate 28 is guided along the guiding face 29*c* of the fixing protrusion portion 29*b*. As shown in FIG. 10, when installation of the plate spring 28 is completed, the fixed piece 28*b* is located at a deep side from the fixing protrusion portion 29*b* in the installation direction. Then, an end of the fixed piece 28*b* is locked by the fixing protrusion portion 29*b* from the deep side in the installation direction, and thereby, the plate spring 28 is fixed to the fixing protrusion portion 29*b*. Thus, the plate spring 28 is capable of being installed in the housing space of the holding part 29 while the curved portion 28*c* is directed to a leading end in the installation direction.

Figure 3:
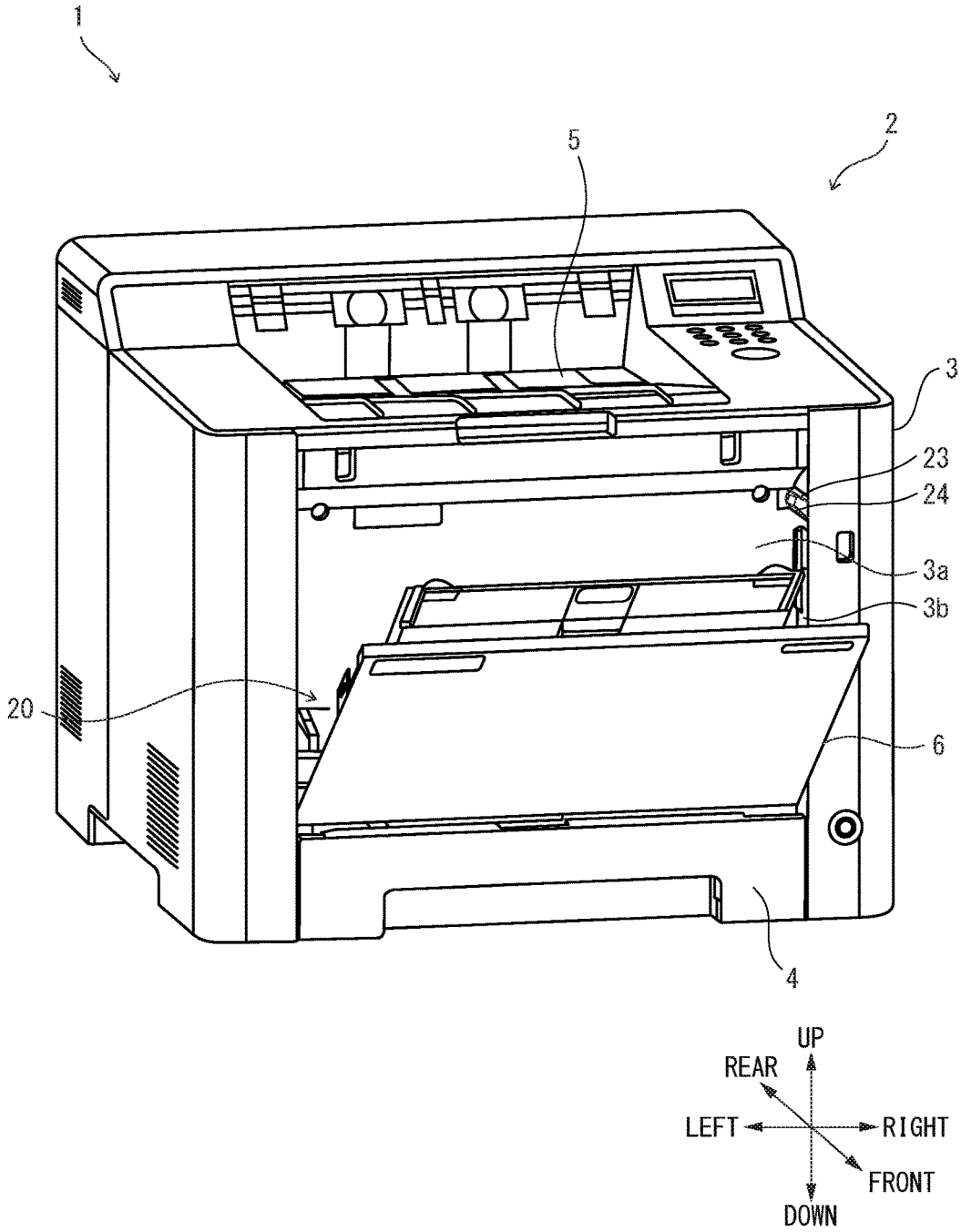
FIG. 3 is a perspective view showing the printer, in a state that a manual bypass tray is turned, according to the embodiment of the present disclosure.

Next, the manual bypass tray 6 will be described. The manual bypass tray 6 is, as shown in FIGS. 2 and 3, a plate-like member capable of being fitted into the storage recessed part 3*a* of the front cover 3. Hereinafter, it will be described so that a lower end of the manual bypass tray 6 in the erected state (a rear end of the manual bypass tray 6 in the laid state) is a proximal end of the manual bypass tray 6 and an upper end of the manual bypass tray 6 in the erected state (a front end of the manual bypass tray 6 in the laid state) is a distal end of the manual bypass tray 6. In other words, the proximal end of the manual bypass tray 6 is positioned at a downstream side in the conveyance direction of the stacked sheet and the distal end of the manual bypass tray 6 is positioned at an upstream side in the conveyance direction of the stacked sheet.

Figure 12:
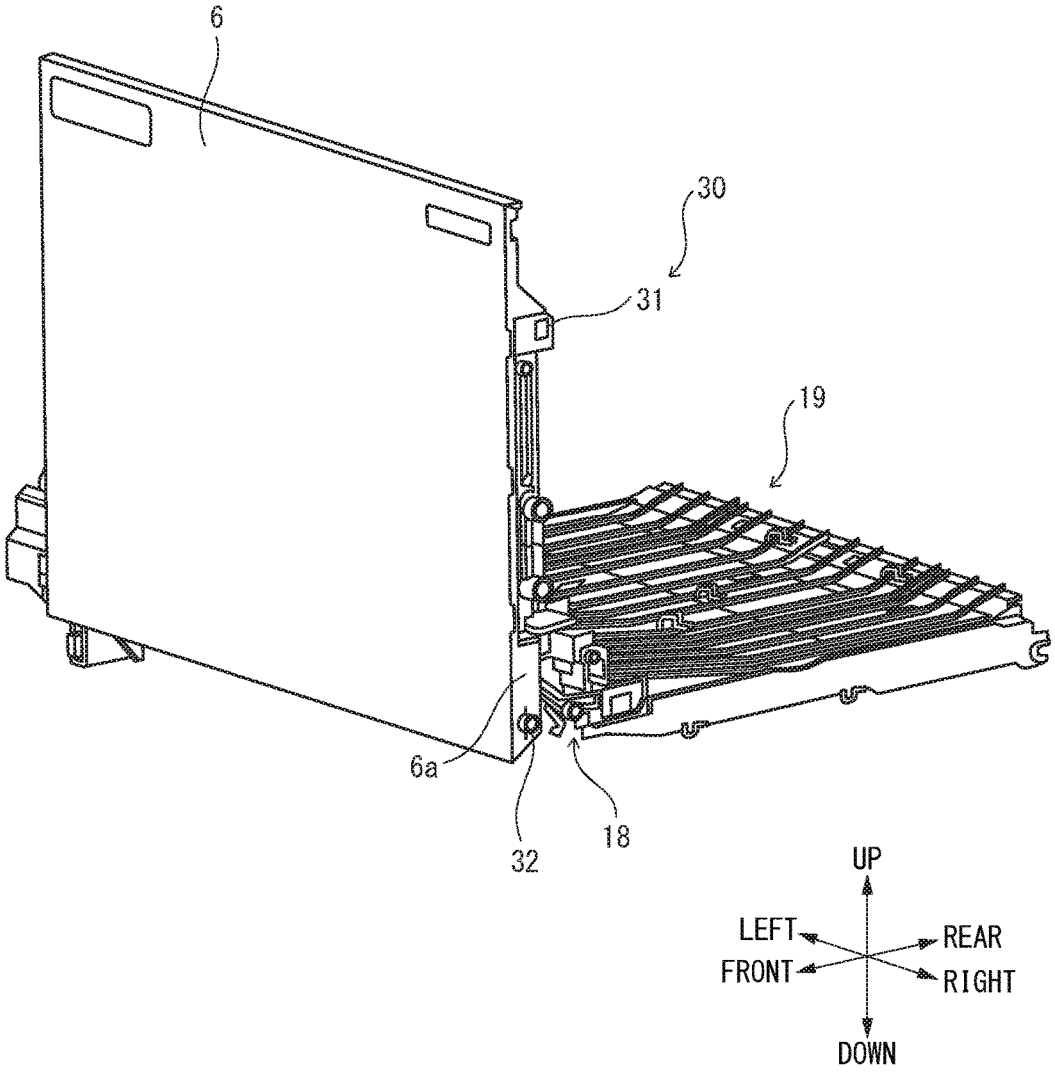
FIG. 12 is a perspective view showing the manual bypass tray and a manual bypass sheet feeding part in the printer according to the embodiment of the present disclosure.

The manual bypass tray 6 includes left and right turning axes 32 (the fulcrum part) having an axis direction of the left and right directions at left and right ends. Incidentally, the right turning axis 32 is shown in FIG. 12, and the left turning axis 32 is not shown. The respective turning axes 32 are formed as positioning bosses protruded outwardly from left and right lateral faces 6*a* of the manual bypass tray 6. The left and right lateral faces 6*a* of the manual bypass tray 6 are supporting walls erected in a vertical direction from the manual bypass tray 6 and supporting the turning axes 32. Each turning axis 32 is arranged in the proximal end of the manual bypass tray 6, in other words, is located at the lower end of the manual bypass tray 6 in the erected state (the rear end of the manual bypass tray 6 in the laid state). The manual bypass tray 6 becomes turnable by attaching (inserting) the left and right turning axes 32 to the left and right bearings 21 of the storage recessed part 3*a*.

Figure 13:
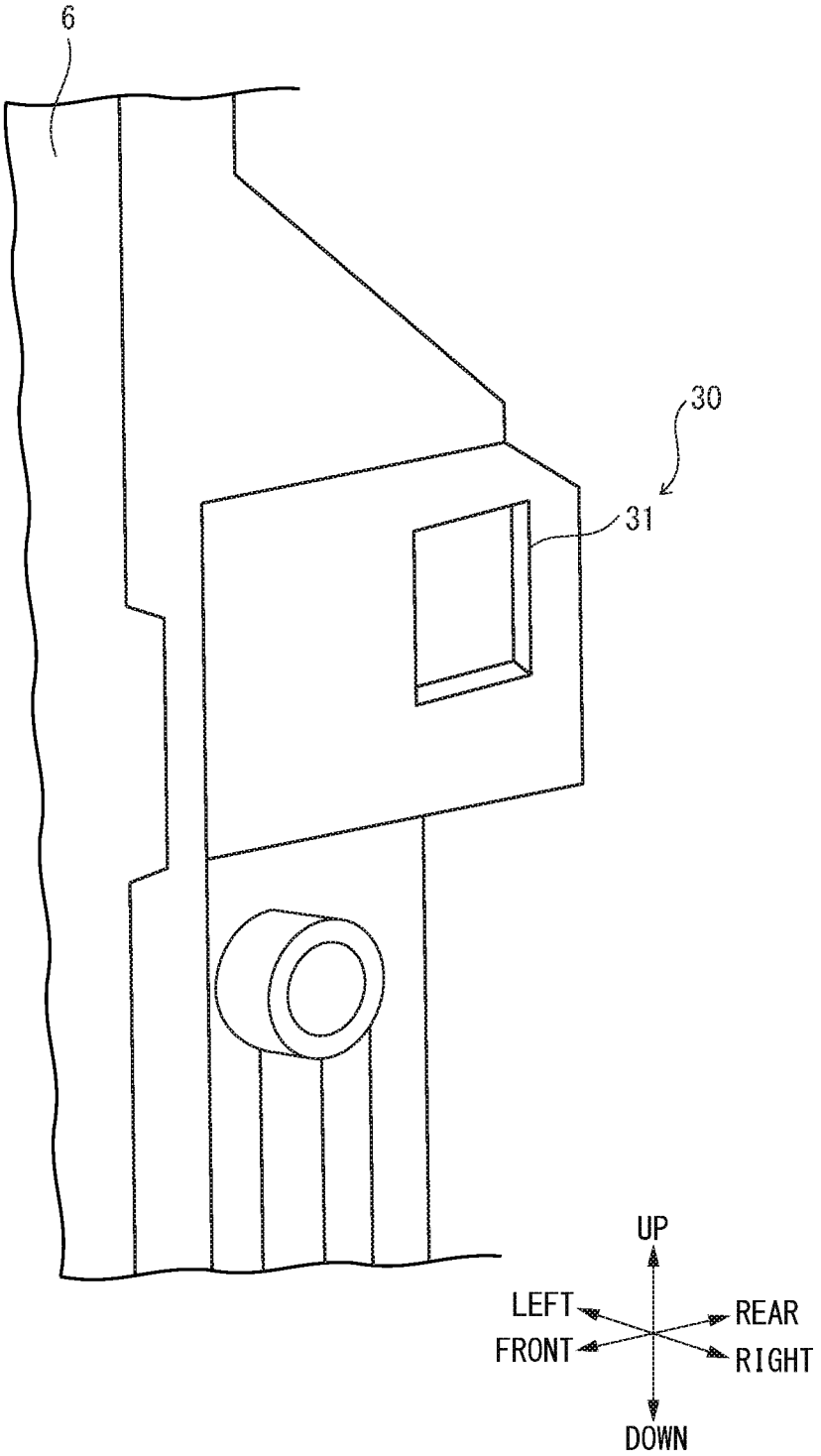
FIG. 13 is a perspective view showing the locked piece of the manual bypass tray in the printer according to the embodiment of the present disclosure.

In addition, the manual bypass tray 6 includes the locked pieces 30 at left and right ends. Incidentally, the right locked piece 30 is shown in FIGS. 12 and 13, and the left locked piece 30 is not shown. The left and right locked pieces 30 are formed symmetrically in the left and right direction to have similar shapes. Hereinafter, the right locked piece 30 will be described except a case of specifying left and right.

The locked piece 30 is arranged at the distal end of the manual bypass tray 6, in other words, arranged at the upper end of the manual bypass tray 6 in the erected state (the front end of the manual bypass tray 6 in the laid state). The locked piece 30 is a plate-like member erected in a vertical direction from the back face of the manual bypass tray 6 and is formed in parallel to the left and right lateral faces 6*a*. Incidentally, the locked piece 30 is produced integrally with the manual bypass tray 6. The locked piece 30 includes the locked hole 31 penetrating in the left and right directions (a direction orthogonal to the close direction).

Incidentally, as shown in FIGS. 6 and 8, the locked piece 30 is arranged at a position corresponding to the locking hook 23 mutually when the manual bypass tray 6 is at the close position. The locked hole 31 of the locked piece 30 is arranged at a position corresponding to the engaging protrusion part 26 of the locking hook 23 mutually. When the manual bypass tray 6 is turned to the close position, a distal end of the locked piece 30 is guided by the first inclined face 26*a* of the engaging protrusion part 26, and simultaneously, the engaging protrusion part 26 is fitted (inserted) into the locked hole 31. Thereby, the locked piece 30 is locked by the locking hook 23, that is, the manual bypass tray 6 is locked by the front cover 3 and the manual bypass tray 6 is kept at the close position. Incidentally, when the engaging protrusion part 26 is inserted into the locked hole 31, an edge of the locked hole 31 comes into contact with the regulating part 27 of the locking hook 23.

In accordance with the embodiment, as described above, the sheet feeding device 20 applied to the printer (the image forming apparatus) includes the storage recessed part 3*a* (the side face of the device body) of the front cover 3 and the manual bypass tray 6 (the bypass tray). The manual bypass tray 6 is supported so as to be turned around the turning axes 32 (the fulcrum part) with respect to the storage recessed part 3*a* between the close position along the storage recessed part 3*a* and the open position being held at a predetermined angle with respect to the storage recessed part 3*a*. The manual bypass tray 6 includes the locked piece 30 arranged above the turning axis 32 and having the locked hole 31. The left and right internal lateral faces 3*b* composing the storage recessed part 3*a* includes the locking hook 23 engaging with the locked piece 30 when the manual bypass tray 6 is at the close position. Moreover, the locking hook 23 includes the arm part 25 being capable of elastically deforming, the engaging protrusion part 26 protruded from the side of the distal end of the arm part 25 to the inward side in the width direction to insert into the locked hole 31, and the regulating part 27 coming into contact with the opening edge of the locked hole 31 to regulate the insertion amount of the engaging protrusion part 26 to the locked hole 31.

According to such a configuration, the locking hook 23, such as the snap-fit, is not deeply fitted because the insertion amount of the locked piece 30 to the locked hole 31 is regulated by the regulating part 27, and thereby, it is possible to prevent immoderate deformation of locking components, such as the locking hook 23. Therefore, it is possible to prevent the locking hook 22 from being left deforming due to repeat of temperature variation of installation environment of the printer 1. Accordingly, it is possible to prevent impossible of opening and closing of the manual bypass tray 6 and to excellently maintain locking performance.

In addition, in accordance with the embodiment, the regulating part 27 is arranged at the side of the distal end of the engaging protrusion part 26 in the arm part 25 and includes the regulating rib 27*a* lower than the protruded height of the engaging protrusion part 26. The regulating rib

27*a* comes into contact with the distal end edge (the opening edge) of the locked hole 31, in a state that the manual bypass tray 6 is arranged at the close position and the engaging protrusion part 26 is engaged with the locked hole 31, to regulate the insertion amount of the engaging protrusion part 26 to the locked hole 31.

Thereby, the regulating part 27 can regulate an insertion amount of the locking hook 23 into the locked piece 30 by a simple configuration.

Further, in accordance with the embodiment, the sheet feeding device 20 further includes the plate spring 28 assisting elastic force of the arm part 25, and the holding part 29 arranged at the side of the back face of the arm part 25 in the storage recessed part 3*a* and holding the plate spring 28. The plate spring 28 is formed in U-shape including the pressing piece 28*a* pressing the arm part 25 and the fixed piece 28*b* held by the holding part 29, and having the curved portion 28*c* connecting the pressing piece 28*a* and the fixed piece 28*b*. The holding part 29 is arranged so as to face to the arm part 25 and has the holding side face 29*a* defining the housing space housing the curved portion 28*c* of the plate spring 28 and the fixing protrusion portion 29*b* (the fixing protrusion) arranged in the holding side face 29*a* and locking the end of the fixed piece 28*b* of the plate spring 28.

Thereby, it is possible to assist locking and restoring of the shape using elastic force of the locking hook 23 by the plate spring 28, and accordingly, to make locking performance to the locked piece 30 excellent, and then, to prevent the plate spring 28 from coming off by the holding part 29.

Moreover, in accordance with the embodiment, the plate spring 28 is capable of being installed in the housing space of the holding part 29 while the curved portion 28*c* is directed to the leading end in the installation direction. The fixing protrusion portion 29*b* has the guiding face 29*c* inclined from the holding side face 29*a* to the side of the arm part 25 and toward the downstream side in the installation direction and guides the fixed piece 28*b* of the plate spring 28 to be installed by the guiding face 29*c*.

Thereby, it is possible to facilitate installation of the plate spring 28 by the guiding face 29*c* of the holding part 29 and to surely prevent the plate spring 28 from coming off by the fixing protrusion portion 29*b* of the holding part 29.

Incidentally, although, in the above-described embodiment, a configuration arranging the manual bypass tray 6 in the storage recessed part 3*a* as the side face of the device body at the front side of the sheet feeding device 20 was described, the position where the manual bypass tray 6 is arranged is not restricted by this. For example, the manual bypass tray 6 may be arranged in another storage recessed part as another side face of the device body at a back side or left or right side of the sheet feeding device 20.

Although, in the above-described embodiment, a turning mechanism of the manual bypass tray 6 including the bearings 21 arranged in the storage recessed part 3*a* and the turning axes 32 arranged in the manual bypass tray 6 was described, the turning mechanism of the manual bypass tray 6 is not restricted by this. For example, in another embodiment, the turning mechanism of the manual bypass tray 6 may include turning axes arranged in the storage recessed part 3*a* and bearings arranged in the manual bypass tray 6.

Although, in the above-described embodiment, a configuration arranging the bearings 21 in the storage recessed part 3*a* was described, the configuration of the bearings 21 is not restricted by this. For example, in another embodiment, the bearings 21 may be arranged in another member, such as an internal frame of the printer body 2 or a special frame to the sheet feeding device 20.

Although, in the above-described embodiment, an arrangement example arranging the locking hooks 23 in the left and right internal lateral faces 3*b* of the front cover 3 and arranging the locked pieces 30 in both left and right end of the manual bypass tray 6 was described, arrangement of the locking hook 23 and the locked piece 30 is not restricted by this. For example, in another embodiment, the locking hook 23 may be arranged in an upper internal face or another position of the front cover 3 and the locked piece 30 may be arranged in an upper side face or another position of the manual bypass tray 6.

Although, in the above-described embodiment, a locking mechanism of the manual bypass tray 6 arranging the locking hook 23 having the engaging protrusion part 26 in the front cover 3 and arranging the locked piece 30 having the locked hole 31 in the manual bypass tray 6 was described, the locking mechanism of the manual bypass tray 6 is not restricted by this. For example, in another embodiment, in another locking mechanism of the manual bypass tray 6, the locking hook having the engaging protrusion part may be arranged in the manual bypass tray 6 and the locked hole may be arranged in the front cover 3.

In other words, the sheet feeding device 20 applied to the printer 1 of another embodiment includes the storage recessed part 3*a* (the side face of the device body) of the front cover 3, the manual bypass tray 6, the locked piece 30 and the locking hook 23. The manual bypass tray 6 includes the bearings as the fulcrum part at lower sides of both ends (left and internal lateral faces 3*b*) in the width direction of the storage recessed part 3*a*. The manual bypass tray 6 is supported so as to be turned around the bearings (the fulcrum part) with respect to the storage recessed part 3*a* between the close position along the storage recessed part 3*a* and the open position held at a predetermined angle with respect to the storage recessed part 3*a* and capable of stacking the sheet to be fed. The locked hole 31 is arranged above the bearing at lower sides in at least any one of both ends in the width direction of storage recessed part 3*a*. The locking hook 23 is arranged in the manual bypass tray 6 and engages with the locked hole 31 when the manual bypass tray 6 is at the close position. Moreover, the locking hook 23 has the outside face at the outward side in the width direction, and includes the arm part 25 being capable of elastically deforming, the engaging protrusion part 26 protruded from the side of the distal end of the arm part 25 to a side of the outside face to insert into the locked hole 31, and the regulating part 27 regulating the insertion amount of the engaging protrusion part 26 to the locked hole 31. By such a configuration, it is possible to achieve similar advantageous to the above-described embodiment. That is, it is possible to prevent immoderate deformation of locking components, such as the locking hook 23, and to make locking performance excellent.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A sheet feeding device comprising:

a storage recessed part composing a side face of a device body; and a bypass tray supported so as to be turned around a turning fulcrum part with respect to the storage recessed part between a close position when being stored in the storage recessed part and an open position held at a predetermined angle with respect to the storage recessed part, wherein the bypass tray includes locked pieces arranged above the turning fulcrum part at both ends of the bypass tray in a width direction along a rotational axial direction of the turning fulcrum part, and the locked pieces have respective locked holes, the storage recessed part includes internal lateral faces defining both side faces of the storage recessed part in the width direction, the internal lateral faces include respective locking hooks engaging with the locked pieces when the bypass tray is at the close position, each of the locking hooks includes:

an arm part being capable of elastically deforming in the width direction;

an engaging protrusion part protruded from a side of a distal end of the arm part to an inward side in the width direction to insert into the locked hole of the corresponding locked piece; and a regulating part coming into contact with an opening edge of the locked hole when the engaging protrusion part inserts into the locked hole to regulate an insertion amount of the engaging protrusion part to the locked hole.

2. The sheet feeding device according to claim 1, wherein the regulating part is arranged at a side of a distal end of the engaging protrusion part in the arm part and includes a regulating rib lower than a protruded height of the engaging protrusion part, the regulating rib comes into contact with the opening edge of the locked hole at a side of insertion of the engaging protrusion part, in a state that the bypass tray is arranged at the close position and the engaging protrusion part is engaged with the locked hole, to regulate the insertion amount of the engaging protrusion part to the locked hole.

3. An image forming apparatus comprising:

the sheet feeding device according to claim 2; and an image forming part forming an image on the sheet fed from the sheet feeding device.

4. An image forming apparatus comprising:

the sheet feeding device according to claim 1; and an image forming part forming an image on the sheet fed from the sheet feeding device.

5. A sheet feeding device comprising:

a side face of a device body;

a bypass tray supported so as to be turned around a turning fulcrum part with respect to the side face between a close position along the side face and an open position held at a predetermined angle with respect to the side face, a plate spring assisting elastic force of the arm part; and a holding part arranged at a side of a back face of the arm part in the side face and holding the plate spring, wherein the bypass tray includes a locked piece arranged above the turning fulcrum part and having a locked hole, the side face includes a locking hook engaging with the locked piece when the bypass tray is at the close position, the locking hook includes:

an arm part being capable of elastically deforming;

an engaging protrusion part protruded from a side of a distal end of the arm part to an inward side in a width direction orthogonal to a conveyance direction of a sheet to insert into the locked hole; and a regulating part coming into contact with an opening edge of the locked hole to regulate an insertion amount of the engaging protrusion part to the locked hole, the regulating part is arranged at a side of a distal end of the engaging protrusion part in the arm part and includes a regulating rib lower than a protruded height of the engaging protrusion part, the regulating rib comes into contact with the opening edge of the locked hole, in a state that the bypass tray is arranged at the close position and the engaging protrusion part is engaged with the locked hole, to regulate the insertion amount of the engaging protrusion part to the locked hole, the plate spring is formed in U-shape including a pressing piece pressing the arm part and a fixed piece held by the holding part, and having a curved portion connecting the pressing piece and the fixed piece, the holding part is arranged so as to face to the arm part and has a holding side face defining a housing space housing the curved portion, and a fixing protrusion arranged in the holding side face and locking an end of the fixed piece.

6. The sheet feeding device according to claim 5, wherein the plate spring is capable of being installed in the housing space while the curved portion is directed to a leading end in an installation direction of the plate spring, the fixing protrusion portion has a guiding face inclined from the holding side face to a side of the arm part and toward a downstream side in the installation direction and guides the fixed piece to be installed by the guiding face.

7. An image forming apparatus comprising:

the sheet feeding device according to claim 6; and an image forming part forming an image on the sheet fed from the sheet feeding device.

8. The sheet feeding device according to claim 5, wherein the side face includes a storage recessed part, the bypass tray is stored in the storage recessed part.

9. An image forming apparatus comprising:

the sheet feeding device according to claim 8; and an image forming part forming an image on the sheet fed from the sheet feeding device.

10. An image forming apparatus comprising:

the sheet feeding device according to claim 5; and an image forming part forming an image on the sheet fed from the sheet feeding device.

* * * * *